US006378786B1

(12) United States Patent
Beeston et al.

(10) Patent No.: US 6,378,786 B1
(45) Date of Patent: Apr. 30, 2002

(54) SPRAYABLE ABRASIVE CLEANING COMPOSITIONS

(75) Inventors: Mark Beeston, Nottingham; Mark Laing, Beverley, both of (GB)

(73) Assignee: Reckitt Benckiser (UK) Limited, Slough (GB)

( * ) Notice: Subject to any disclaimer, the term of this patent is extended or adjusted under 35 U.S.C. 154(b) by 0 days.

(21) Appl. No.: 09/331,494

(22) PCT Filed: Dec. 23, 1997

(86) PCT No.: PCT/GB97/03539

§ 371 Date: Aug. 3, 1999

§ 102(e) Date: Aug. 3, 1999

(87) PCT Pub. No.: WO98/29193

PCT Pub. Date: Jul. 9, 1998

(30) Foreign Application Priority Data

Dec. 31, 1996 (GB) ..... 9627098

(51) Int. Cl.[7] ..... B05B 9/043
(52) U.S. Cl. ..... 239/333; 239/490
(58) Field of Search ..... 239/305, 312, 239/333, 405, 408, 411, 490

(56) References Cited

U.S. PATENT DOCUMENTS

| | | | | | |
|---|---|---|---|---|---|
| 3,705,687 | A | * | 12/1972 | Vincentini et al. | 239/92 |
| 3,976,223 | A | * | 8/1976 | Jass et al. | 222/94 |
| 4,056,213 | A | | 11/1977 | Stern | 222/95 |
| 4,287,079 | A | | 9/1981 | Robinson | 252/99 |
| 4,362,256 | A | * | 12/1982 | Polasek | 222/383 |
| 4,583,692 | A | | 4/1986 | Sheffler et al. | 239/405 |
| 4,611,644 | A | * | 9/1986 | Cox | 239/229 |
| 4,628,644 | A | * | 12/1986 | Somers | 51/427 |
| 4,804,144 | A | * | 2/1989 | Denman | 239/346 |
| 4,872,293 | A | | 10/1989 | Yasukawa et al. | 51/410 |
| 5,279,568 | A | | 1/1994 | Cater | 604/152 |
| 5,388,766 | A | | 2/1995 | Buisson | 239/333 |
| 5,558,562 | A | | 9/1996 | Diat | 451/98 |
| 5,618,001 | A | * | 4/1997 | Del Gaone et al. | 239/346 |
| 5,731,279 | A | * | 3/1998 | Pancheri | 510/340 |

FOREIGN PATENT DOCUMENTS

| | | | | |
|---|---|---|---|---|
| EP | 0 193 375 | A | 9/1986 | C11D/17/00 |
| EP | 0 322 485 | A | 2/1989 | B26F/3/00 |
| EP | 0 449 046 | A | 10/1991 | B05B/11/00 |
| WO | WO91/08282 | A | 6/1991 | C11D/17/00 |
| WO | WO94/17143 | | 8/1994 | C09D/9/00 |

OTHER PUBLICATIONS

Copy of PCT International Search Report for PCT/GB97/03539 dated Apr. 8, 1998.
Copy of a GB Examination Report for GB Application No. 9627098.8 dated Jun. 13, 2000.

* cited by examiner

*Primary Examiner*—Lesley D. Morris
(74) *Attorney, Agent, or Firm*—Fish & Richardson P.C.

(57) ABSTRACT

A spraying device comprising a reservoir and a nozzle linked by a path is used to apply an aqueous cleaning composition to a surface. The interim dimension of the path is located immediately upstream of the nozzle. The composition comprises abrasive particles, wherein substantially none of the particles has a maximum dimension which is more than half of the minimum dimension of the path and none of said particles have a dimension greater than said minimum dimension.

8 Claims, 3 Drawing Sheets

SPRAYABLE ABRASIVE CLEANING COMPOSITIONS

BACKGROUND OF THE INVENTION

This invention relates to the cleaning of surfaces and more particularly is concerned with the cleaning of surfaces using compositions containing abrasive particles.

Cleaning compositions containing abrasive particles are well known and may generally be classified into two types. The first type contain water-insoluble abrasive particles. These particles are often difficult to rinse away from the cleaned surface and can leave an undesirable gritty residue on the surface. In order to overcome these disadvantages, the second type of composition has been proposed in which the abrasive particles are water soluble. These compositions contain the water-soluble abrasive particles in an amount greater than that required to achieve a saturated solution. Thus, undissolved abrasive particles are always present in the composition. Because the abrasive particles are water soluble, particles remaining on the surface after cleaning tend to be dissolved on rinsing the surface and are thus removed from the surface. Cleaning compositions containing water soluble abrasive particles are described in EP 0 193 375 and WO 91/08282.

Cleaning compositions of this general type are particularly suitable for cleaning hard surfaces especially in kitchens and bathrooms such as sinks, ceramic hobs, washbasins, baths, shower trays and shower stalls, lavatories, work surfaces and the like.

Conventionally, such general cleaning compositions are marketed in containers formed of flexible plastics material so that the compositions can be ejected, from the container, by squeezing it.

Attempts have been made to apply abrasive cleaning compositions to a surface to be cleaned by means of a spraying device (trigger). Generally, however, these attempts have not been successful because the nozzle of the spraying device tended to become blocked by the abrasive particles.

It is an object of the present invention to provide a sprayable abrasive cleaning composition and a spraying device therefor.

SUMMARY OF THE INVENTION

According to the present invention there is provided a spraying device including a reservoir containing a cleaning composition comprising abrasive particles and an aqueous vehicle liquid; a nozzle through which the composition can be sprayed on actuation of the spraying device; and a path for enabling the composition to pass from the reservoir to the nozzle, substantially none of the abrasive particles having a maximum dimension which is more than one half of the minimum dimension of the path and none of the particles having a dimension greater than said minimum dimension.

By"substantially none" there is meant not more than 4%, by weight, and preferably not more than 2%, by weight.

DETAILED DISCLOSURE

Figure 1:
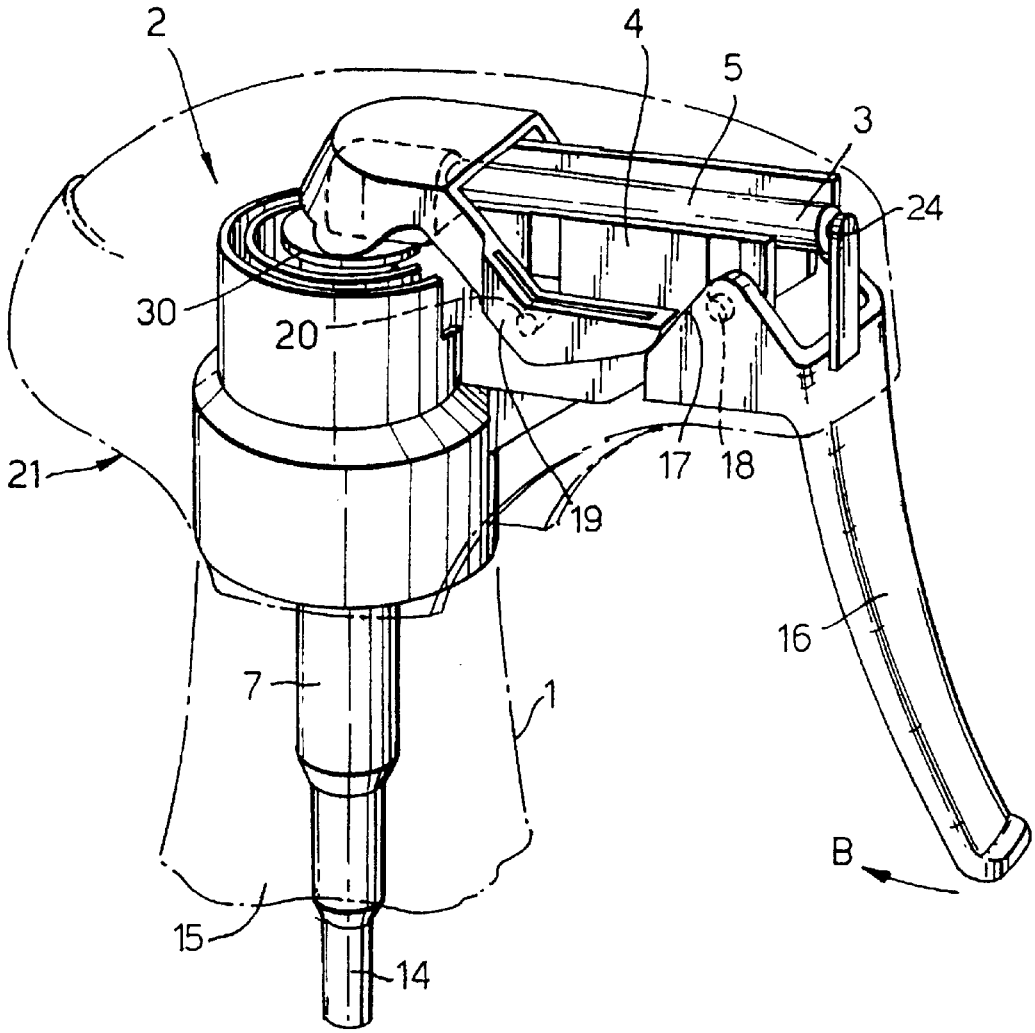
FIG. 1 is a perspective view of a part of one embodiment of a spraying device for use in the combination of the invention.
Figure 2:
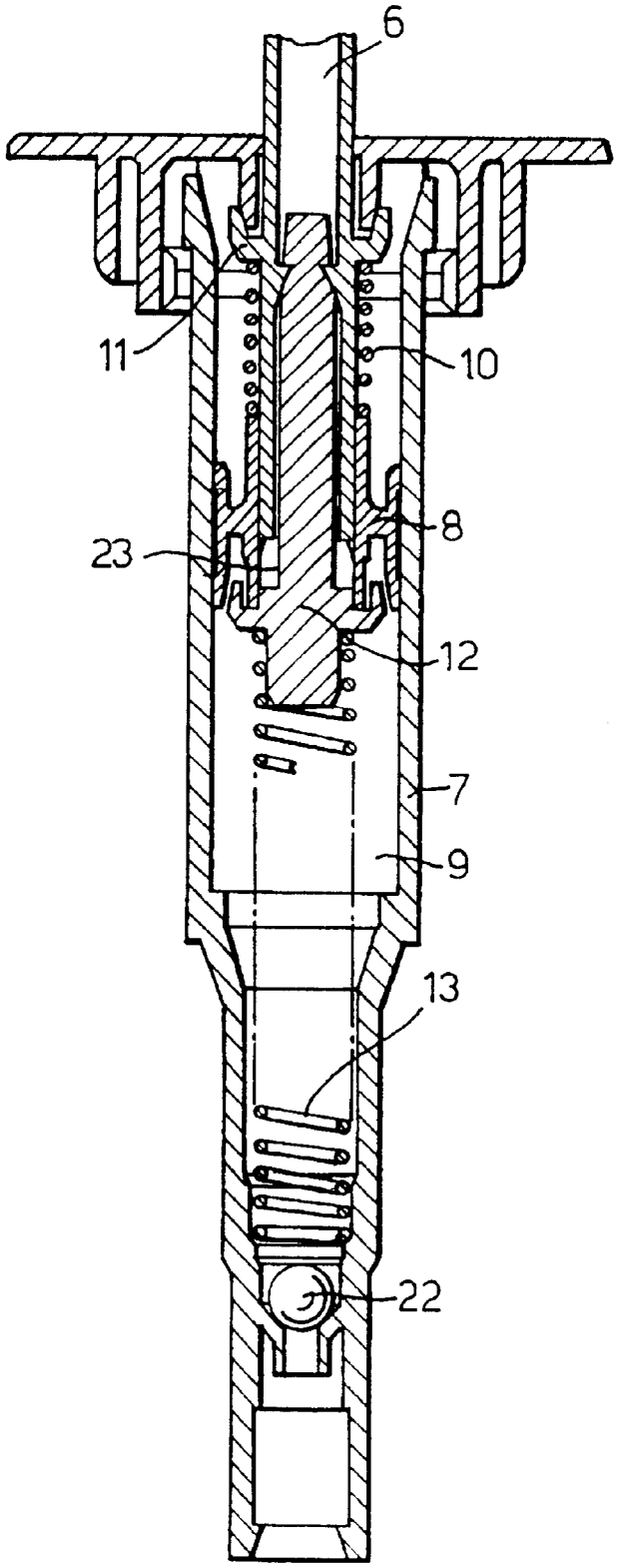
FIG. 2 is a cross section through a part of the device shown in FIG. 1 on an increased scale.
Figure 3:
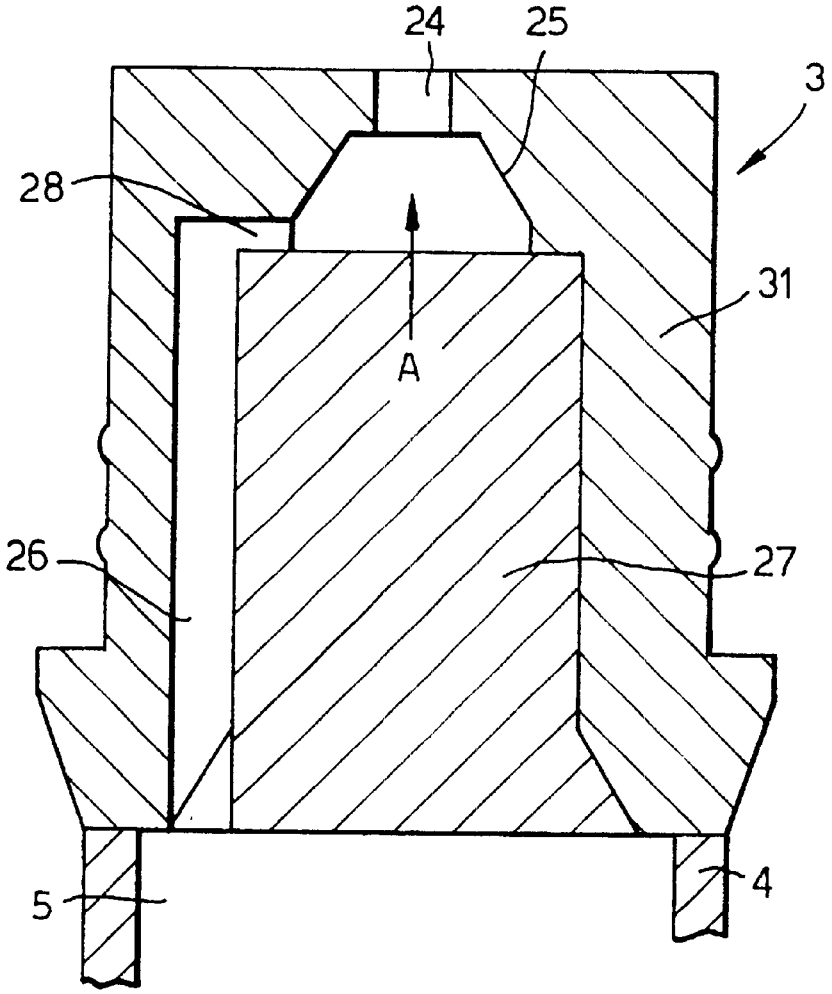
FIG. 3 is a cross section through another part of the device shown in FIG. 1 on an increased scale.
Figure 4:
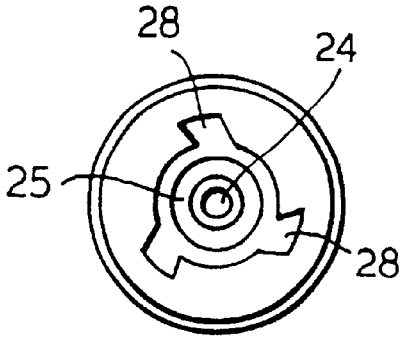
FIG. 4 is a view of the part shown in FIG. 3 from the direction A on a reduced scale.

Advantageously, the minimum dimension of the path is in the form of a minimum restriction located immediately upstream of the nozzle since, in this way, an improved spray pattern of the composition can be obtained. This restriction has the function of increasing the velocity of the composition and breaking it up into a spray rather than a single jet of composition. Such is particularly important with high viscosity compositions.

Commonly, the size distribution of the particles is such that the mean size is closer to the maximum size than would normally be the case in accordance with a normal Gaussian distribution.

Typically, the composition may include from 1 to 60% by weight of abrasive particles and preferably from 1 to 40% by weight. Most preferably, the content of abrasive particles is from 5 to 30% by weight.

Suitable examples of abrasive particles are silicon dioxide, aluminium oxide, polishing earth, calcium carbonate, dicalcium phosphate, iron oxide, magnesium silicates, calcium pyrophosphate, diatomaceous earth (Kieselguhr) and sodium metaphosphate.

In general, water insoluble abrasives are preferred. However, if desired, water soluble abrasives such as alkali metal carbonates, bicarbonates and sulphates may be used. Preferred water soluble abrasive particles include sodium bicarbonate, sodium tripolyphosphate pentahydrate, sodium tetraborate decahydrate, potassium sulphate and sodium citrate. Additionally or alternatively, other water soluble salts may be included, such as sodium chloride, potassium chloride, magnesium chloride, calcium chloride and other inorganic or organic water soluble salts of lithium, magnesium, sodium, potassium, and calcium, of which sodium oxalate, sodium succinate, sodium adipate and sodium glutarate are examples.

The water soluble abrasive particles must be present in an amount in excess of the saturation solubility, so that in the composition the soluble salt comprising the abrasive particles is present in both the dissolved and the undissolved state. Preferably, the water soluble salt is present in total in an amount of 15% to 60% by weight, particularly 30% to 50% by weight, and especially about 40% by weight of the composition.

One of the criteria used in selecting the abrasive particles is the hardness of the particles. The particles should have a hardness less than that of the surfaces to be cleaned, in order to avoid scratching the surfaces. Thus, the particles will usually have a hardness less than that of the plastics materials, for example acrylics, conventionally used for baths and like. A Mohs hardness of at least 2 and less than 4, preferably less than 3 will in general be suitable. For specific applications, particles of higher hardness can be used.

It is important that the compositions of the invention are stable in use and storage so that the abrasive particles remain in suspension. It may usually be expected that the compositions will be stored and used at temperatures generally within the range of 0° C. to 40° C. It is therefore preferable, where soluble abrasive particles are used to choose salts whose saturation solubility changes to the minimum extent over this temperature range. Particularly, it is preferable that the saturation solubility of the salt in water at 40° C. is less than 10 times, most preferably less than 8 times, and especially less than 2 times that at 10° C.

To ensure that the composition contains undissolved abrasive particles, the salt forming the abrasive particles will preferably have a saturation solubility at 10° C. of not more than 15% by weight. In order to ensure that the abrasive particles may easily be rinsed from the surface after cleaning, the salt will preferably have a solubility in water of at least 5 g/l at 10° C.

The composition may include additional components such as one or more of from 0.1 to 15% by weight of a surfactant, from 0.1 to 6% by weight of a thickening/suspending agent, up to 30% by weight of an organic solvent, up to 4% by weight of an antibacterial agent, up to 2% by weight of a perfume and up to 5% by weight of a silicone.

Suitable surfactants are anionic, non-ionic, amphoteric and cationic surfactants.

Suitable nonionic surfactants which can be used in the instant invention include water soluble nonionic surfactants, many of which are well known and conventionally used in the art. Nonlimiting examples of nonionic surfactants which may be employed in the composition include those which are water soluble or water miscible and include one or more of the following: amine oxides, block copolymers, alkoxylated alkanolamides, ethoxylated alcohols, and ethoxylated alkyl phenols, and the like. Other commercially available nonionic surfactants may be found in the"Chemical Classification" section of McCutcheon's *Emulsifier & Detergents North American Edition*, 1991 and also in *Surfactants Europa*, 3rd *edn, Hollis* (Ed) 1995.

Useful water soluble nonionic surfactants in the compositions according to the present invention include commercially well known surfactant compositions, including the primary aliphatic alcohol ethoxylates, secondary aliphatic alcohol ethoxylates, alkylphenol ethoxylates and ethylene-oxide-propylene oxide condensates of primary alkanols. These water soluble nonionic surfactants are generally the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with a hydrophilic group containing an ethylene oxide and/or the polyhydration product thereof, polyethylene glycol, to form a water soluble nonionic surfactant.

Useful nonionic surfactants include the condensation products of a higher alcohol (e.g. an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide, tridecanol condensed with about 6 to 10 moles of ethylene oxide, myristyl alcohol condensed with about 10 moles of ethylene oxide per mole of myristyl alcohol, the condensation product of ethylene oxide with a cut of coconut fatty alcohol containing a mixture of fatty alcohols with alkyl chains varying from 10 to about 14 carbon atoms in length and wherein the condensate contains either about 6 moles of ethylene oxide per mole of total alcohol or about 9 moles of ethylene oxide per mole of alcohol and tallow alcohol ethyoxlates containing 6 moles ethylene oxide to 11 moles ethylene oxide per mole of alcohol.

A preferred group of the foregoing nonionic surfactants is certain ethoxylates presently commercially available under the trade name Neodol® (Shell Chemical) which are believed to be higher aliphatic, primary alcohols containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neodol® 23-6.5), $C_{12-15}$ alkanol condensed with 12 moles ethylene oxide (Neodol® 25-12), $C_{14-15}$ alkanol condensed with 13 moles ethylene oxide (Neodol® 45-13), and the like. Such ethoxylates have an HLB (hydrophobic to lipophilic balance) value of about 8 to 15 and give good oil/water emulsification, whereas ethoxylates with HLB values below 8 contain less than 5 ethylene oxide groups and tend to be poor emulsifiers and poor detergents.

Additional satisfactory nonionic surfactant compositions include the condensation products of secondary aliphatic alcohols containing 8 to 18 carbon atoms in a straight or branched chain configuration condensed with 5 to 30 moles of ethylene oxide. Examples of commercially available nonionic detergents of the foregoing type are those presently commercially available under the trade name of Tergitol® (Union Carbide Ltd) such as Tergitol 15-S-12 which is described as being $C_{11}$–$C_{15}$ secondary alkanol condensed with 9 ethylene oxide units, or Tergitol 15-S-9 which is described as being $C_{11}$–$C_{15}$ secondary alkanol condensed with 12 ethylene oxide units per molecule.

Other suitable nonionic surfactant compositions include the polyethylene oxide condensates of one mole of alkyl phenol containing from about 8 to 18 carbon atoms in a straight-or branched chain alkyl group with about 5 to 30 moles of ethylene oxide. Specific examples of alkyl phenol ethoxylates include nonyl phenol condensed with about 9.5 moles of ethylene oxide per mole of nonyl phenol, dinonyl phenol condensed with about 12 moles of ethylene oxide per mole of phenol, dinonyl phenol condensed with about 15 moles of ethylene oxide per mole of phenol and diisoctylphenol condensed with about 15 moles of ethylene oxide per mole of phenol. Commercially available nonionic surfactants of this type include those which are presently commercially available under the trade name of Igepal® (Rhone-Poulenc, Chemicals Ltd).

Also among the satisfactory nonionic surfactants which find use with the present inventive compositions are the water-soluble condensation products of a $C_8$–$C_{20}$ alkanol with a mixture of ethylene oxide and propylene oxide wherein the weight ratio of ethylene oxide to propylene oxide is from 2.5:1 to 4.1, preferably 2.89:1 to 3.3:1, with the total of the ethylene oxide and propylene oxide (including the terminal ethanol or propanol group) being from 60–85%, preferably 70 to 80%, by weight. Such surfactants include those which are presently commercially available under the trade name of Plurafac® (BASF plc). Further useful water-soluble condensation products of $C_8$–$C_{20}$ alkanol with a mixture of ethylene oxide and/or propylene oxide include those which are presently marketed under the trade name Poly-Tergent SL (Olin UK Ltd) series of nonionic surfactants which are cited to comprise between 5 and 12 moles of oxyethylene per molecule.

Other suitable water-soluble nonionic detergents which are less preferred but which are nonetheless useful are those which are marketed under the trade name Pluronics® (BASF plc). The compounds are formed by condensing ethylene oxide with a hydrophobic base formed by the condensation of propylene oxide with propylene glycol. The molecular weight of the hydrophobic portion of the molecule is of the order of 950 to 4,000 and preferably 200 to 2,500. The addition of polyoxyethylene radicals of the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants are in liquid form and particularly satisfactory surfactants are available as those marketed as Pluronics® L62 and Pluronics L64.

Alkylmonoglyocosides and alkylpolyglycosides which find use in the present inventive compositions include known nonionic surfactants which are alkaline and electrolyte stable. Alkylmonoglycosides and alkylpolyglucosides are prepared generally by reacting a monosaccharide, or a compound hydrolyzable to a monosaccharide with an alcohol such as a fatty alcohol in an acid medium. Various glycoside and polyglycoside compounds including alkoxylated glycosides and processes for making them are disclosed in U.S. Pat. No. 2,974,134; U.S. Pat. No. 3,219,656; Pat. No. 3,598,865, U.S. Pat. No. 3,640,998; U.S. Pat. No. 3,707,535; U.S. Pat. No. 3,772,269; U.S. Pat. No. 3,839,318; U.S. Pat. No. 3,974,138; U.S. Pat. No. 4,223,129 and U.S. Pat. No. 4,528,106.

One exemplary group of such useful alkylpolyglycosides includes those according to the formula:

$$R_2O—(C_nH_{2n}O)_r—(Z)_x$$

where Z is derived from glucose, $R_2$ is a hydrophobic group selected from alkyl groups, alkylphenyl groups, hydroxylalkylphenyl groups as well as mixtures thereof, wherein the alkyl groups may be straight chained or branched, which contain from about 8 to about 18 carbon atoms, n is 2 or 3, r is an integer from 0 to 10, but is preferably 0, and x is a value from about 1 to 8, preferably from about 1.5 to 5. Preferably the alkylpolyglycosides are nonionic fatty alkylpolyglucosides which contain a straight chain or branched chain $C_8$–$C_{15}$ alkyl group, and have an average of from about 1 to 5 glucose units per fatty alkylpolyglucoside molecule. More preferable, are the nonionic fatty alkylpolyglucosides which contain straight chain or branched $C_8$–$C_{15}$ alkyl group, and have an average of from about 1 to about 2 glucose units per fatty alkylpolyglucoside molecule.

A further exemplary group of alkyl glycoside surfactants suitable for use in the practice of this invention may be represented by formula $$RO—(R_1O)_y—(G)_xZ_b$$

wherein: R is a monovalent organic radical containing from about 6 to about 30, preferably from about 8 to 18 carbon atoms; $R_1$ is a divalent hydrocarbon radical containing from about 2 to about 4 carbon atoms; O is an oxygen atom; y is a number which has an average value from about 0 to about 1 and is preferably 0, G is a moiety derived from reducing a saccharide containing 5 or 6 carbon atoms; and x is a number having an average value from about 1 to 5 (preferably from 1.1 to 2); Z is $O_2M^1$, $$—\overset{O}{\overset{\|}{C}}O—R_2$$

$O(CH_2)$, $CO_2M^1$, $OSO_3M^1$, or $O(CH_2)SO_3M^1$; $R_2$ is $(CH_2)CO_2M^1$ or $CH{=}CHCO_2M^1$; (with the proviso that Z can be $O_2M^1$ only if Z is in place of a primary hydroxyl group in which the primary hydroxyl-bearing carbon atom, $—CH_2OH$, is oxidized to form a $$—\overset{O}{\overset{\|}{C}}—OM^1$$

group), b is a number of from 0 to 3x+1 preferably an average of from 0.5 to 2 per glycosal group; p is 1 to 10, $M^1$ is $H^+$ or an organic or inorganic counterion, particularly cations such as, for example, an alkali metal cation, ammonium cation, monoethanolamine cation or calcium cation.

As defined in Formula above, R is generally the residue of a fatty alcohol having from about 8 to 30 and preferably 8 to 18 carbon atoms. Examples of such alkylglycosides as described above include, for example APG™ 325 CS Glycoside® which is described as being a 50% $C_9$–$C_{11}$ alkyl polyglycoside, also commonly referred to as D-glucopyranoside, (commercially available from Henkel Ltd) and Glucopon™ 625 CS which is described as being a 50% $C_{10}$–$C_{16}$ alkyl polyglycoside, also commonly referred to as a D-glucopyranoside, (available from Henkel Ltd).

The nonionic surfactant can be present either singly, or as a mixture of two or more nonionic surfactant compounds as defined above.

Suitable anionic surfactants include, but are not limited to: alkali metal salts, ammonium salts, amine salts, aminoalcohol salts or the magnesium salts of one or more of the following compounds: alkyl sulfates, alkyl ether sulfates, alkylamidether sulfates, alkyl aryl polyether sulfates, monoglyceride sulfates, alkylsufonates, alkylamide sulfonates, alkylarylsulfonates, olefinsulphonates, paraffin sulfonates, alkyl sulfosuccinates, alkyl ether sulfosuccinates, alkylamide sulfosuccinates, alkyl sulfosuccinamate, alkyl sulfoacetates, alkyl phosphates, alkyl ether phosphates, acyl sarconsinates, acyl isethionates, and N-acyl taurates. Generally, the alkyl or acyl radicals in these various compounds comprise a carbon chain containing 12 to 20 carbon atoms.

Further exemplary anionic surfactants which may be used include fatty acid salts, including salts of oleic, ricinoleic, palmitic, and stearic acids; copra oils or hydrogenated copra oil acid, and acyl lactylates whose acyl radical contains 8 to 20 carbon atoms.

Particularly useful anionic surfactants include the water-soluble salts, particularly the alkali metal, ammonium and alkylolammonium (e.g. monoethanolammonium or triethanolammonium) salts, of organic sulfiric reaction products having in their molecular structure an alkyl group containing from about 10 to about 20 carbon atoms and a sulfonic acid or sulfuric acid ester group. (Included in the term"alkyl" is the alkyl portion of aryl groups.) Examples of this group of synthetic surfactants are the alkyl sulfates, especially those obtained by sulfating the higher alcohols (C8–C18 carbon atoms) such as those produced by reducing the glycerides of tallow or coconut oil, and the alkylbenzene sulfonates in which the alkyl group contains from about 9 to about 15 carbon atoms, in straight chain or branched chain. Especially valuable are linear straight chain alkylbenzene sulfonates in which the average number of carbon atoms in the alkyl group is from about 11 to 14.

Other anionic surfactants herein are the water soluble salts of: paraffin sulfonates containing from about 8 to about 24 (preferably about 12 to 18) carbon atoms; alkyl glyceryl ether sulfonates, especially those ethers of C8–C18 alcohols (e.g. those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants herein include the water soluble salts of esters of α-sulfonated fatty acids containing from about 0 to 20 carbon atoms in the fatty acid group and from about 1 to 10 carbon atoms in the ester group; water soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms β-alkyloxy alkane sulfonates containing from about 1 to 3 carbon atoms in the alkyl group and from about 8 to 20 carbon atoms in the alkane moiety.

Particularly preferred alkyl sulfate anionic surfactants useful in forming the compositions of the invention are alkyl sulfates of the formula

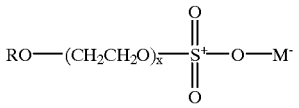

wherein R is a straight chain or branched alkyl chain having from about 8 to about 18 carbon atoms, saturated or unsaturated, and the longest linear portion of the alkyl chain is 15 carbon atoms or less on the average, M is a cation which makes the compound water soluble, especially an alkali metal such as sodium, or an ammonium or substituted ammonium cation, and x is from 0 to about 4. Most preferred are the non-ethoxylated C12–15 primary and secondary alkyl sulfates.

Exemplary commercially available alkyl sulfates include one or more of those available under the tradename RHODAPON® from Rhone Poulenc Co. (Cherry Hill, N.J.), as well as STEPANOL® from Stepan Chemical Co. (Northfield, Ill.). An exemplary alkyl sulfate which is preferred for use is a sodium lauryl sulfate surfactant presently commercially available as RHODAPON® LCP from Rhône Poulenc Co., as well as a further sodium lauryl sulfate surfactant composition which is presently commercially available as STEPANOL® WAC from Stepan Chemical Co.

Particularly preferred alkyl sulfonate anionic surfactants useful in forming the compositions of the present invention are alkyl sulfonates according to the formula:

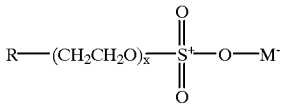

wherein R is a straight chain or branched alkyl chain having from about 8 to about 18 carbon atoms, saturated or unsaturated, and the longest linear portion of the alkyl chain is 15 carbon atoms or less on the average, M is a cation which makes the compound water soluble, especially an alkali metal such as sodium, or is an ammonium or substituted ammonium cation, and x is from 0 to about 4. Most preferred are the nonethoxylated C12–15 primary and secondary alkyl sulfates.

Exemplary, commercially available alkane sulfonate surfactants include one or more of those available under the tradename HOSTAPUR® from Hoeschst Celanese. An exemplary alkane sulfonate which is preferred for use is a secondary sodium alkane sulfonate surfactant presently commercially available as HOSTAPUR® SAS from Hoeschst Celanese.

Other anionic surface active agents not particularly enumerated here may also find use in the present invention.

Solvents usable in the compositions of the present invention may be selected from solvents known in the art, of which volatile silicones, n-paraffins, alcohols, glycol ethers, propylene glycol, dipropylene glycol, iso-paraffins and amino methyl propanol are particularly suitable.

An important function of the solvents included in the inventive formulations is the removal of fat and grease deposits. In principle, any solvent capable of removal of such deposits, which meets environmental and safety requirements and which may stably be included in the inventive formulations without deleteriously affecting desirable properties of the compositions, may be included.

It is desirable that at least a portion of the abrasive particles in the compositions of the invention should be maintained in suspension, in order to obviate the need for excessive shaking or agitation of the composition by the consumer prior to use. To this end, the compositions of the invention preferably include a thickening agent. The thickening agent may be such as to provide the composition with a generally Newtonian viscosity. Preferably, the composition may be provided with a structured rheology, such as a shear thinning rheology, Generally, for compositions with Newtonian viscosity, the viscosity will be in the range of from 200 to 600 Cps (as measured using a Brookfield DV-III viscometer, Spindle CP42). Where the composition has a structured rheology, the measured viscosity may be considerably higher. Suitable thickeners and rheology modifiers include polysaccharides such as hydroxy celluloses, carboxy methyl celluloses, polyacrylates and other thickening media known in the art such as natural gums, alginates, silica aerogels, silica precipitates and natural and synthetic clays.

Examples of suitable antibacterial agents are phenolic compounds and cationic bactericides.

Silicones are preferably included to act as an internal lubricant and suitable silicones are dimethicone and polydimethylsiloxanes.

The spraying device may be, for example, a simple finger pump or any conventional spraying device either of the type including a simple pump mechanism or of the type where the material to be sprayed is pre-compressed (such as described in EP-0449046).

Referring now to the drawings, there is shown a spraying device comprising a container having a reservoir 15 defined by walls 1 for accommodating the composition (not shown) and terminating in an opening to which is secured a spraying arrangement generally denoted by reference number 2. The spraying arrangement comprises a nozzle member 3 secured in a first end of an actuator extension 4, including a delivery bore 5, which is secured, at its second end, to a delivery head 30 including a conduit 6 with which bore 5 is in communication. The conduit 6 is in the form of a tube which is located within an outer tubular casing 7 and axially displaceable with respect thereto. A piston 8 is mounted in sealing engagement with the outer periphery of the conduit 6. The piston 8 is also in sealing engagement with the inner surface of outer casing 7. Thus axial displacement of the conduit 6 varies the volume of a chamber 9 defined between conduit 6, casing 7, piston 8, and ball 22 of a ball valve. A precompression spring 10 is provided, around the outer surface of conduit 6, and has one end abutting against a first end of the piston 8 and its other end abutting against a flange 11 on the outer periphery of the conduit 6. A poppet valve arrangement is provided at the second end of the piston 8. This comprises a cylindrical body 12 in the conduit 6 and including an external flange having a first face abutting against the second end of the piston 8 and a second face abutting against one end of a spring 13 having its other end fixed to the internal surface of the casing 7. At its free end, the outer casing 7 fits around a dip tube 14 opening into the composition in the reservoir 15. The spraying device includes a hand lever 16 including an abutment 17 which, when the lever 16 is pivoted about pivot point 18 in the direction shown in arrow B, abuts against one end of a rocking lever 19 pivoted about pivot 20 so that another end of the rocking lever 19 acts on the delivery head 30 to axially displace the conduit 6 with respect to the casing 7. The spraying arrangement is enveloped in a cap 21.

The nozzle member 3 at the end of the actuator extension 4 comprises a cup-shaped body 31 having, in its end wall, a nozzle comprising an orifice 24 of diameter about 500 mm formed in a conically shaped recess 25. The recess 25 is in communication with a conduit 26 formed within the cup-shaped body 31 by an insert 27. Three tangentially arranged ducts 28 link the conduit 26 with the conical recess 25. Thus there is a path extending between the reservoir 15 containing the composition and the orifice 24 which path comprises the dip tube 14, the chamber 9, the conduit 6, the bore 5, the conduit 26, the ducts 28 and the recess 25. The conduit 26 has a dimension of 350 mm, and that part of the path which has a minimum dimension is the duct 28 which defines a restriction of 200 mm. Thus, the smallest restriction is immediately upstream of the nozzle member 3.

In use, the hand lever 16 is actuated in the direction indicted by the arrow B which causes the conduit 6 to be axially displaced downwardly towards the ball 22. The ball 22 is free to move up and down between lower and upper positions. In its lower position it closes the chamber 9 from the dip tube 14. In its upper position it allows composition to pass from the dip tube 14 into chamber 9. As the conduit 6 is axially displaced in this way, it carries with it the piston 8 due to the presence of the precompression spring 10. This movement of the piston 8 causes a similar movement of the body 10 against spring 13 and compresses the chamber 9. The air initially in chamber 9 is replaced by composition from the reservoir 15 as the lever 16 is actuated. When the pressure in the chamber 9 reaches a critical level set by the precompression spring 10, it causes the piston 8 to move axially in the opposite direction, overcoming the action of the spring 10 thereby allowing composition under pressure to pass into zone 23 which is in communication with conduit 6. Thus, when the pressure in the chamber 9 exceeds the critical level, composition is forced from the chamber 9 to the nozzle 24 via consuit 6 and bore 5 of actuator extension 4.

The following Examples illustrate the invention. In these examples, all parts are parts by weight unless there is an indication to the contrary.

EXAMPLE 1

An aqueous abrasive cleaning composition was prepared as follows:

| | |
|---|---|
| Chalk | 10% |
| Sodium lauryl sulphate (28%) | 2% |
| Monoethanolamine | 0.4% |
| Cyclodimethicone/dimethicone | 9% |
| Polydimethysiloxane | 0.5% |
| Water | 77.9% |

The chalk was Fordacal 200 (produced by milling a very pure bright deposit of crystalline calcium carbonate (55.5% CaO, 43.9% $CO_2$) and its particle size distribution was as follows:

| Chalk (Fordacal 200) | | |
|---|---|---|
| >5.8 | microns | 95% |
| >10.5 | microns | 50.8% |
| >18.9 | microns | 59% |
| >34.1 | microns | 27% |
| >53 | microns | 11% |
| >71.4 | microns | 4.3% |
| >100 | microns | 1.2% |
| >200 | microns | 0% |

The composition could be very satisfactorily sprayed using a spraying device as described in the drawings. More particularly, the nozzle of the nozzle member 3 did not become blocked and, moreover, the composition emanating from the orifice 24 had a desirable spray pattern.

EXAMPLE 2

An aqueous abrasive cleaning composition was prepared as follows:

| | |
|---|---|
| Diatomaceous Earth | 10% |
| Hydroxyethyl cellulose | 1% |
| Sodium lauryl sulphate (28%) | 2% |
| Isopropyl Alcohol | 5% |
| Ethoxylated Alcohol | 3% |
| Polydimethylsiloxane | 0.5% |
| Perfume | 0.6% |
| Water | 77.9% |

The particle size distribution of the diatomaceous earth was as follows:

| | | |
|---|---|---|
| >1 | microns | 96.8% |
| >5 | microns | 76.6% |
| >10 | microns | 50.8% |
| >20 | microns | 15.3% |
| >35 | microns | 3.0% |
| >50 | microns | 1.1% |
| >75 | microns | 0.3% |
| >100 | microns | 0.2% |
| >200 | microns | 0% |

Results similar to that of Example 1 were obtained when the composition as sprayed through the spraying device shown in the drawings.

EXAMPLE 3

Different grades of Fordacal were made into water based abrasive cleaner compositions comprising 10% of the Fordacal and each was sprayed using the spraying device shown in the drawings. As can be seen from the following Table, the range of particles of sizes used varied from a top cut (that is, the maximum size of particles within the particle size range as distinct from the average particle size) of 1000 microns to a top cut of only 12 microns.

TABLE

| PRODUCT | MEAN SIZE MICRONS | TOP CUT MICRONS | SPRAY |
|---|---|---|---|
| Fordacal 16 | 300 | 1,000 | NO |
| Fordacal 25 | 200 | 750 | NO |
| Fordacal 36 | 150 | 600 | NO |
| Fordacal 60 | 60 | 200 | NO |
| Fordacal 100 | 25 | 150 | NO |
| Fordacal 200 | 20 | 100 | YES |
| Fordacal 300 | 15 | 75 | YES |
| Fordacal 45 | 12 | 45 | YES |
| Fordacal 30 | 7 | 30 | YES |
| Fordacal 10 | 2 | 12 | YES |

It can be seen that any Fordacal grades with a top cut of smaller than or equal to 100 microns was successfully sprayed and did not cause the spraying device to fail.

Any grades of Fordacal with a top cut grater than or equal to 150 microns did not spray and caused the spraying device to fail.

EXAMPLE 4

To differentiate between the importance of mean particle size and top cut an experiment was carried out where a Fordacal grade that had been successfully sprayed was mixed with a grade that did not spray in the above test. The grades used were Fordacal 200 (mean particle size 20 microns and top cut size of 100 microns) and Fordacal 60 (mean particle size 60 microns and top cut size of 200 microns). This meant that the mean particle size of Fordacal 60 was less than the size of the top cut of Fordacal 200.

In the first embodiment Fordacal 200 was mixed with Fordacal 60 to give a 50%:50% mixture of Fordacal 200 and Fordacal 60.

This mixture did not spray.

In a second experiment Fordacal 200 was mixed with Fordacal 60 to give a 75%:25% mixture of Fordacal 200 and Fordacal 60.

This mixture did not spray.

This example suggests that the mean particle size is far less important than the top cut size.

What is claimed is:

1. In combination, (1) a cleaning composition comprising abrasive particles and an aqueous vehicle liquid, and (2) a spraying device in which a manually-operated pump provides pressurized air at a single level of pressure, said device including a reservoir adapted to contain said cleaning composition, a nozzle through which the composition can be sprayed on actuation of the spraying device, and a path of varying dimension for enabling the composition to pass from the reservoir to the nozzle, substantially none of the abrasive particles having a maximum dimension which is more than one half of the minimum dimension of the path and none of the particles having a dimension greater than said minimum dimension.

2. The combination of claim 1, wherein the location of said minimum dimension is immediately upstream of the nozzle.

3. The combination of claim 2, wherein the abrasive particles are particles of silicon dioxide, aluminum oxide, polishing earth, calcium carbonate, dicalcium phosphate, iron oxide, magnesium silicate, calcium pyrophosphate, diatomaceous earth, sodium metaphosphate or mixtures thereof.

4. The combination of claim 2, wherein the abrasive particles are particles of a water soluble salt.

5. The combination of claim 4, wherein the water soluble salt is an alkali metal carbonate, bicarbonate or sulphate.

6. The combination of claim 2 wherein the composition additionally includes one or more of a surfactant, thickening/suspending agent, an organic solvent, an antibacterial agent, a perfume, or a silicone.

7. The combination of claim 6 in which the cleaning composition comprises a nonionic surfactant.

8. The combination of claim 6 in which the cleaning composition comprises an anionic surfactant.

* * * * *